US011724355B2

(12) United States Patent
Wong et al.

(10) Patent No.: US 11,724,355 B2
(45) Date of Patent: Aug. 15, 2023

(54) SUBSTRATE POLISH EDGE UNIFORMITY CONTROL WITH SECONDARY FLUID DISPENSE

(71) Applicant: Applied Materials, Inc., Santa Clara, CA (US)

(72) Inventors: Justin H. Wong, Pleasanton, CA (US); Kevin H. Song, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 372 days.

(21) Appl. No.: 17/038,793

(22) Filed: Sep. 30, 2020

(65) Prior Publication Data

US 2022/0097198 A1 Mar. 31, 2022

(51) Int. Cl.

| | |
|---|---|
| ***B24B 37/015*** | (2012.01) |
| ***B24B 37/10*** | (2012.01) |
| ***B24B 57/02*** | (2006.01) |
| ***B24B 37/013*** | (2012.01) |
| ***B24B 49/12*** | (2006.01) |
| ***B24B 37/20*** | (2012.01) |
| *B24B 37/32* | (2012.01) |

(52) U.S. Cl.

CPC ..... *B24B 37/013* (2013.01); *B24B 37/015* (2013.01); *B24B 37/105* (2013.01); *B24B 37/205* (2013.01); *B24B 49/12* (2013.01); *B24B 57/02* (2013.01); *B24B 37/32* (2013.01)

(58) Field of Classification Search

CPC ... B24B 37/013; B24B 37/015; B24B 37/105; B24B 57/02

USPC ..... 451/1, 5, 7, 41, 37, 53, 287

See application file for complete search history.

(56) References Cited

U.S. PATENT DOCUMENTS

| | | | |
|---|---|---|---|
| 5,645,682 | A | 7/1997 | Skrovan |
| 5,705,435 | A | 1/1998 | Chen |
| 5,709,593 | A | 1/1998 | Guthrie et al. |

(Continued)

FOREIGN PATENT DOCUMENTS

| | | | |
|---|---|---|---|
| CN | 101291777 | A | 10/2008 |
| CN | 103878688 | A | 6/2014 |

(Continued)

OTHER PUBLICATIONS

Chinese Search Report dated Oct. 9, 2018 for Application No. 2015800677560.

(Continued)

*Primary Examiner* — Joel D Crandall
*Assistant Examiner* — Shantese L McDonald
(74) *Attorney, Agent, or Firm* — Patterson + Sheridan, LLP

(57) ABSTRACT

A method and apparatus for dispensing polishing fluids and onto a polishing pad within a chemical mechanical polishing (CMP) system are disclosed herein. In particular, embodiments herein relate to a CMP system with a first fluid delivery arm and a second fluid delivery arm disposed over the polishing pad to dispense liquid, such as a polishing fluid or water. The first fluid delivery arm is disposed over at least 50% of the radius of the polishing pad, while the second fluid delivery arm is disposed over less than 50% of the radius of the polishing pad. The second fluid delivery arm is configured to dispense either a polishing fluid or a water onto the polishing pad to effect the polishing rate at the edge of the substrate.

20 Claims, 5 Drawing Sheets

(56) References Cited

U.S. PATENT DOCUMENTS

| | | | |
|---|---|---|---|
| 5,728,224 | A | 3/1998 | Laurent |
| 5,779,522 | A | 7/1998 | Walker et al. |
| 5,795,215 | A | 8/1998 | Guthrie et al. |
| 5,916,010 | A | 6/1999 | Varian et al. |
| 5,957,751 | A | 9/1999 | Govzman et al. |
| 5,997,392 | A | 12/1999 | Chamberlin |
| 6,022,414 | A | 2/2000 | Miller |
| 6,080,050 | A | 6/2000 | Chen et al. |
| 6,132,298 | A | 10/2000 | Zuniga et al. |
| 6,139,404 | A | 10/2000 | Yau |
| 6,146,259 | A | 11/2000 | Zuniga et al. |
| 6,159,079 | A | 12/2000 | Zuniga et al. |
| 6,162,116 | A | 12/2000 | Zuniga et al. |
| 6,165,058 | A | 12/2000 | Zuniga et al. |
| 6,227,947 | B1 | 5/2001 | Hu et al. |
| 6,241,593 | B1 | 6/2001 | Chen et al. |
| 6,284,092 | B1 | 9/2001 | Manfredi |
| 6,358,121 | B1 | 3/2002 | Zuniga |
| 6,361,419 | B1 | 3/2002 | Zuniga et al. |
| 6,383,332 | B1 | 5/2002 | Shelton |
| 6,386,963 | B1 | 5/2002 | Kenji et al. |
| 6,572,446 | B1 | 6/2003 | Osterheld et al. |
| 6,602,114 | B1 | 8/2003 | Wang et al. |
| 6,609,957 | B2 | 8/2003 | Chopra |
| 6,609,962 | B1 | 8/2003 | Wakabayashi et al. |
| 6,645,044 | B2 | 11/2003 | Zuniga |
| 6,663,466 | B2 | 12/2003 | Chen et al. |
| 6,722,965 | B2 | 4/2004 | Zuniga et al. |
| 6,776,694 | B2 | 8/2004 | Zuniga et al. |
| 6,835,125 | B1 | 12/2004 | Tseng et al. |
| 6,848,980 | B2 | 2/2005 | Chen et al. |
| 6,890,249 | B1 | 5/2005 | Zuniga et al. |
| 6,899,592 | B1 | 5/2005 | Kojima et al. |
| 7,001,257 | B2 | 2/2006 | Chen et al. |
| 7,001,260 | B2 | 2/2006 | Chen et al. |
| 7,004,820 | B1 | 2/2006 | Teng et al. |
| 7,021,999 | B2 | 4/2006 | Jiang |
| 7,182,680 | B2 | 2/2007 | Butterfield et al. |
| 7,207,871 | B1 | 4/2007 | Zuniga et al. |
| 7,210,988 | B2 | 5/2007 | Wang |
| 7,255,771 | B2 | 8/2007 | Chen et al. |
| 7,455,575 | B2 | 11/2008 | Kim |
| 7,459,057 | B2 | 12/2008 | Zuniga et al. |
| 7,534,364 | B2 | 5/2009 | Zuniga et al. |
| 7,666,061 | B2 | 2/2010 | Butterfield et al. |
| 7,753,761 | B2 | 7/2010 | Fujita |
| 9,550,270 | B2 * | 1/2017 | Hung ..... B24B 37/015 |
| 9,751,189 | B2 | 9/2017 | Chen et al. |
| 10,350,728 | B2 | 7/2019 | Diao et al. |
| 2002/0016136 | A1 | 2/2002 | Birang et al. |
| 2004/0087257 | A1 | 5/2004 | Hong |
| 2005/0164603 | A1 | 7/2005 | House et al. |
| 2007/0207707 | A1 | 9/2007 | Montierth et al. |
| 2008/0132152 | A1 * | 6/2008 | Kiesel ..... B24B 37/04 451/37 |
| 2009/0194509 | A1 | 8/2009 | Nada |
| 2010/0048106 | A1 | 2/2010 | Wang et al. |
| 2010/0279435 | A1 * | 11/2010 | Xu ..... B24B 55/02 156/345.13 |
| 2011/0180512 | A1 * | 7/2011 | Bosar ..... B44C 1/227 216/84 |
| 2014/0273763 | A1 | 9/2014 | Lee et al. |
| 2015/0024661 | A1 * | 1/2015 | Peng ..... B08B 3/02 451/72 |
| 2016/0114459 | A1 | 4/2016 | Butterfield |
| 2017/0194159 | A1 | 7/2017 | Lin |
| 2019/0054590 | A1 * | 2/2019 | Huang ..... B24B 37/042 |

FOREIGN PATENT DOCUMENTS

| | | | |
|---|---|---|---|
| JP | 2008270360 | A | 11/2008 |
| KR | 10-2005-0049714 | A | 5/2005 |
| KR | 1020100034618 | A | 4/2010 |
| TW | 467803 | B | 12/2001 |
| TW | 200833465 | A | 8/2008 |
| WO | 2020176385 | | 9/2020 |

OTHER PUBLICATIONS

International Search Report and Written Opinion dated Nov. 24, 2021 for Application No. PCT/US2021/045070.

* cited by examiner

SUBSTRATE POLISH EDGE UNIFORMITY CONTROL WITH SECONDARY FLUID DISPENSE

BACKGROUND

Field

Embodiments of the present disclosure generally relate to chemical mechanical polishing (CMP) systems used in the manufacturing of semiconductor devices. In particular, embodiments herein relate to apparatus and method for uniform material removal at an edge of a substrate during CMP processing.

Description of the Related Art

Chemical mechanical polishing (CMP) is commonly used in the manufacturing of semiconductor devices to planarize or polish a layer of material deposited on a substrate surface. In a typical CMP process, a substrate is retained in a substrate carrier which presses the backside of the substrate towards a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

The polishing fluid is generally dispensed onto the polishing pad from a first arm towards the center of the polishing pad so that the polishing fluid migrates towards an outer edge of the polishing pad as the polishing pad rotated. The polishing fluid often accumulates near the edge of the substrate underneath the substrate carrier. The accumulation of the polishing fluid near the substrate edge results in uneven substrate material removal profiles and either increased or decreased removal rates near the edge. Even when polishing fluid is dispersed evenly under the substrate, interaction between the substrate and the retaining ring of the substrate carrier causes non-uniformities near the edge of the substrate during CMP processes.

Accordingly, there is a need in the art for articles and related methods that solve the problem described above.

SUMMARY

The present disclosure generally relates to a chemical mechanical polishing apparatus. More specifically, the disclosure relates to first and second fluid distribution arms which distribute polishing fluids. In one embodiment, an apparatus for processing a substrate is disclosed which includes a pad disposed on a platen, wherein the pad has a pad radius and a central axis from which the pad radius extends. The apparatus further includes a carrier assembly configured to be disposed on a surface of the pad and having a carrier radius that extends from a rotational axis of the carrier assembly, wherein the rotational axis is disposed at a first radial distance from the central axis; a first fluid delivery arm having a first nozzle configured to provide a first fluid to a first point on the pad at a second radial distance from the central axis; and a second fluid delivery arm having a second nozzle configured to provide a second fluid to a second point on the pad, the second point disposed a third radial distance from the central axis, wherein the second radial distance is less than the first radial distance, and the third radial distance is greater than or equal to the second radial distance.

In another embodiment of the present disclosure, an apparatus for processing a substrate includes a platen; a pad disposed on the platen, the pad having a pad radius extending from a central axis; a carrier assembly disposed on the pad having a carrier radius that extends from a rotational axis of the carrier assembly; a first fluid delivery arm extending over at least 50% of the pad radius; and a second fluid delivery arm extending over less than 60% of the pad radius. The first fluid delivery arm is configured to provide a first fluid to a first point on the pad and the second fluid delivery arm is configured to provide a second fluid to a second point on the pad. The second point is disposed a radial distance from the central axis, the radial distance being greater than about 40% of the pad radius In another embodiment of the present disclosure, a method of polishing a substrate includes urging a substrate against a surface of a pad of a polishing system using a carrier assembly, wherein the pad has a pad radius and a central axis from which the pad radius extends. The carrier assembly is translated across a surface of the pad while rotating the carrier assembly about a rotational axis, wherein translating the carrier assembly across a surface of the pad causes a first radial distance measured from the central axis to the rotational axis to vary between a first radial value and a second radial value as the carrier assembly is translated across the surface of the pad. A first fluid is dispensed onto the pad from a first fluid delivery arm at a first temperature and a first flow rate, wherein the first fluid is delivered to the pad at a second radial distance that is measured from the central axis. A second fluid is dispensed onto the pad from a second fluid delivery arm at a second flow rate and at a second temperature, wherein the second fluid is delivered to the pad at a third radial distance that is measured from the central axis, such that the second fluid is delivered to a portion of the substrate at least 40% of a radius of the pad from a central axis of the pad. The dispensing of the second fluid and the first fluid are stopped.

In yet another embodiment of the present disclosure, a method of polishing a substrate includes urging a substrate against a surface of a pad of a polishing system using a carrier assembly, wherein the pad has a pad radius and a central axis from which the pad radius extends. The carrier assembly is translated across a surface of the pad while rotating the carrier assembly about a rotational axis. A first fluid is dispensed onto the pad from a first fluid delivery arm at a first temperature and a first flow rate, wherein the first fluid is delivered to the pad at a second radial distance that is measured from the central axis. A second fluid is dispensed onto the pad from a second fluid delivery arm at a second flow rate and at a second temperature, wherein the second fluid is delivered to the pad at a third radial distance that is measured from the central axis, such that the third radial distance is greater than the second radial distance. The dispensing of the second fluid and the first fluid are stopped.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
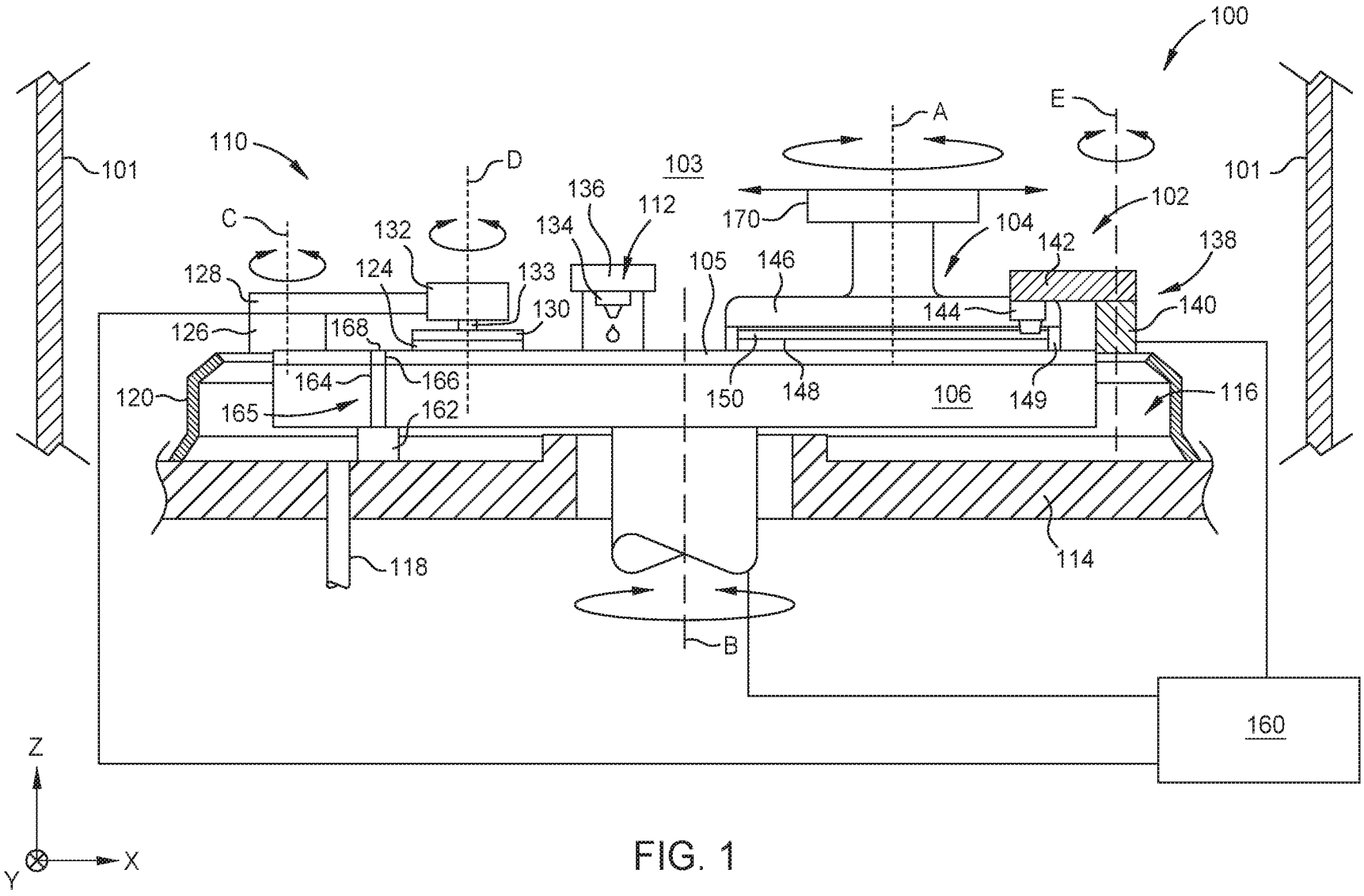
FIG. 1 is a schematic side view of a polishing system that may be used with the methods provided herein, according to one embodiment.

Embodiments of the present disclosure generally relate to apparatus and method for improving planarization uniformity of a chemical mechanical polishing (CMP) process by controlling the delivery of polishing fluids onto a polishing pad within a CMP system. In particular, embodiments herein relate to a CMP system with a first fluid delivery arm and a second fluid delivery arm disposed over the polishing pad to dispense liquid, such as a polishing fluid or water.

The first fluid delivery arm is positioned to deliver a polishing fluid to an inner portion of the polishing pad, such that the first fluid delivery arm supplies polishing fluid to polish the substrate. The second fluid delivery arm is positioned such that the second fluid delivery arm supplies one or more polishing fluids and/or water to the polishing pad. The first fluid delivery arm and the second fluid delivery arm are positioned to supply polishing fluids and/or water to different portions of the polishing pad. In some embodiments, the first fluid delivery arm supplies one or more polishing fluids and/or water closer to a center of the polishing pad, whereas the second fluid delivery arm supplies one or more polishing fluids and/or water closer to the outer edge of the polishing pad. The second fluid delivery arm may be configured to dispense a fluid at a position on the polishing pad radially outward of a position on the polishing pad that a fluid is dispensed from the first fluid delivery arm. In some embodiments, the second fluid delivery arm is positioned such that a fluid is dispensed over a different portion of the polishing pad, which is in a desired position relative to an edge of the substrate while a substrate carrier urges the substrate against the polishing pad. The fluid dispensed by the second fluid delivery arm interacts with the fluid dispensed by the first fluid delivery arm as the substrate and the polishing pad rotate to provide improved polishing results on the processed substrate.

As is discussed further below, the second fluid delivery arm is moveable and may move in a synchronized pattern with the substrate carrier, such that the second fluid delivery arm delivers a fluid to the polishing pad at a consistent distance from the substrate carrier as the substrate carrier is moved relative to the polishing pad and platen, which supports the polishing pad. Alternatively, the second fluid delivery arm is configured to deliver fluid to the polishing pad at a desired radius of the polishing pad which coincides with a desired position on the substrate carrier and substrate. In some embodiments, the second fluid delivery arm moves to accommodate the change in position of the substrate carrier from a first carrier position to a second carrier position and delivers fluid to a portion of the polishing pad which will intersect a desired portion of the substrate carrier.

It has been found that the results of a CMP process can be controlled by changing the distribution and/or concentration of polishing fluid disposed between a substrate and the surface of the polishing pad. In some embodiments, planarization uniformity is improved by changing the concentration of polishing fluids near an edge of the substrate while polishing. The first fluid delivery arm is generally used to provide polishing fluids which are dispersed across the polishing pad and underneath the entirety of the substrate carrier. The polishing fluids under the edge of the substrate carrier closest to the edge of the polishing pad have been found to accumulate between a retaining ring and the substrate. The accumulation of polishing fluids can either accelerate or decelerate the polishing rate near the edge of the substrate depending upon the type of polishing fluid, the consistency of the polishing fluid, the composition of the polishing fluid, the thickness of the accumulated polishing fluid, the rate or rotation of the substrate, and the temperature of the polishing fluid.

The accumulation of polishing fluids near the edge of the substrate is able to be controlled by the delivery of fluids from both of the first fluid delivery arm and the second fluid delivery arm. As the first fluid delivery arm is supplying fluid which will interact with the entirety of the substrate, controlling the accumulation of polishing fluid near the edge of the substrate using the fluid dispensed from the first fluid delivery arm is difficult. It has been found that the concentration and quantity of one or more polishing fluids near the edge of the substrate can be better controlled when utilizing a second fluid delivery arm. The second fluid delivery arm provides an additional control parameter and may be positioned so that fluid delivered from the second fluid delivery arm directly interacts with fluid near a desired position on the substrate (e.g., substrate edge) without interacting with other portions of the substrate (e.g., inner or central portion of the substrate).

In embodiments in which the dispensed liquid from the second fluid delivery arm includes a polishing fluid, the amount of polishing fluid accumulated near the edge and/or other region of the substrate can be increased. In embodiments in which the liquid dispensed by the second fluid deliver arm is water, the composition of the polishing fluid accumulated near the edge and/or other region of the substrate is decreased as the water may thin the polishing fluid and cause the polishing fluid to disperse from the position near the edge and/or other region of the substrate. A typical polishing fluid used in a CMP process may comprise an aqueous solution of one or more chemical constituents along with nanoscale abrasive particles suspended in the aqueous solution. The increase or decrease in fluid accumulation and fluid component concentration, such as polishing fluid accumulation and the concentration of the abrasive particles and/or chemical composition of the polishing fluid, near the edge of the substrate during CMP processing can accelerate or decelerate the removal rate near the edge of the substrate.

By dispensing liquid from the second fluid delivery arm, the polishing rate at the substrate edge can be controlled by controlling the delivery of one or more fluids to a desired position relative to the substrate and the polishing pad. The process of controlling the delivery of the one or more fluids, in addition to the slurry delivered by the first delivery arm, will typically include the process of controlling the relative position of the delivery of the one or more fluids relative to a region of the substrate. In some configurations, the process takes into account the geometry of the pad and or platen and how the fluid travels along the polishing pad and under the substrate carrier and substrate to deliver fluid to desired portions of the substrate, such as the edges of the substrate, without substantially impacting the concentration and/or flow of fluid across other regions of the substrate, such as the center of the substrate. In some embodiments, the substrate carrier rotation speed and the platen rotation speeds may vary. The rotation speed of both the platen and also the substrate carrier assembly may impact the effect the polishing fluids have on the polishing process. This may alter process results and be used to obtain desired results. In some embodiments the substrate carrier is rotated at a speed of about 30 revolutions per minute (rpm) to about 165 rpm, such as about 50 rpm to about 150 rpm. In some embodiments, the substrate carrier assembly may be held still while the platen rotates. The platen may rotate at a speed of about 10 rpm to about 175 rpm, such as about 35 rpm to about 160 rpm. In some embodiments the substrate carrier and the platen may rotate at either higher or lower rotational speed ranges than those listed herein and may be adjusted to accommodate different polishing applications. While in some embodiments both the substrate carrier and the platen are rotated at a similar speed, in other embodiments, the substrate carrier and the platen are rotated at dissimilar speeds, such that either the substrate carrier is rotating faster than the platen or the platen is rotating faster than the substrate carrier. In embodiments disclosed herein, the edge of the substrate is defined as the outermost 10 mm of the substrate, such that the center portion of the substrate is the innermost 140 mm of the radius for a 300 mm substrate. The amount and type of the one or more fluids delivered to the polishing pad by the second fluid delivery arm is controlled to achieve more uniform substrate polishing results. The amount and type of fluid varies depending upon the type of polishing being completed. In some embodiments, a metrology tool can be disposed within the polishing system to measure the thickness of the substrate edge and determine a removal rate. The dispensing of the liquid from the second fluid delivery arm is then controllable based upon the measured removal rate by the metrology tool.

FIG. 1 is a schematic side view of a polishing system 100 that may be used with the methods provided herein, according to one embodiment. Typically, the polishing system 100 features a frame (not shown) and a plurality of panels 101 which define a substrate processing environment 103. The polishing system 100 includes a plurality of polishing stations 102 (one shown) and a plurality of substrate carrier assemblies 104 (one shown) which are disposed within the substrate processing environment 103.

As shown in FIG. 1, a polishing station 102 includes a platen 106, a polishing pad 105 mounted on the platen 106 and secured thereto, a pad conditioner assembly 110 for cleaning and/or rejuvenating the polishing pad, a first fluid delivery arm 112 for dispensing polishing fluid onto the polishing pad 105, a second fluid delivery arm 138 for dispending one or more fluids (e.g., a polishing fluid or a water) onto the polishing pad 105, a rotating substrate carrier assembly 104 configured to be disposed on the polishing pad 105, and a controller 160. The controller 160 is connected to each of the platen 106, the pad conditioner assembly 110, the first fluid delivery arm 112, and the second fluid delivery arm 138. Here, the platen 106 is disposed above a base plate 114 and is circumscribed by a platen shield 120 (both shown in cross section) which collectively define a drainage basin 116. The drainage basin 116 is used to collect fluids spun radially outward from the platen 106 and to drain the fluids through a drain 118 in fluid communication therewith.

The pad conditioner assembly 110 is used to clean and/or rejuvenate the polishing pad 105 by sweeping polishing byproducts therefrom, such as with a brush (not shown), and/or by abrading the polishing pad 105 by urging an abrasive pad conditioning disk 124 (e.g., a diamond impregnated disk) there against. Pad conditioning operations may be done between polishing substrates, i.e., ex-situ conditioning, concurrently with polishing a substrate, i.e., in-situ conditioning, or both.

Here, the pad conditioner assembly 110 includes a first conditioner actuator 126 disposed on the base plate 114, a conditioner arm 128 coupled to the first conditioner actuator 126, and a conditioner mounting plate 130 having the conditioner disk 124 fixedly coupled thereto. A first end of the conditioner arm 128 is coupled to the first conditioner actuator 126, and the mounting plate 130 is coupled to a second end of the conditioner arm 128 that is distal from the first end. The first conditioner actuator 126 is used to sweep the conditioner arm 128, and thus the conditioner disk 124, about an axis C so that the conditioner disk 124 oscillates between an inner radius of the polishing pad 105 and an outer radius of the polishing pad 105 while the polishing pad 105 rotates there beneath. In some embodiments, the pad conditioner assembly 110 further includes a second conditioner actuator 132 disposed at, and coupled to, the second end of the conditioner arm 128, the second conditioner actuator 132 is used to rotate the conditioner disk 124 about an axis D. Typically, the mounting plate 130 is coupled to the second conditioner actuator 132 using a shaft 133 disposed there between.

Generally, the rotating substrate carrier assembly 104 is swept back and forth across a desired region of the platen 106 while the platen 106, and thus the polishing pad 105, rotate about a platen axis B there beneath. In some configurations, the substrate carrier assembly 104 rotates and moves in a radial direction relative to the polishing pad 105 and platen 106, such that the substrate carrier assembly 104 can move along the radius of the rotating polishing pad 105. In other configurations, the substrate carrier assembly 104 rotates and moves in arcuate path relative to the center of the CMP polishing system (not shown), and thus in a non-radial direction across the polishing pad 105 and platen 106. The substrate carrier assembly 104 is rotated and moved using a first actuator 170. The first actuator 170 is connected to the substrate carrier assembly 104 at a shaft and may include a track or a set of tracks (not shown) to enable movement of the substrate carrier assembly 104 in either of a radial or an arcuate path across the surface of the pad. The polishing fluid is delivered to the polishing pad 105 using the first fluid delivery arm 112 positioned there over and is further delivered to a polishing interface between polishing pad 105 and the substrate 148 by the rotation of the polishing pad 105 about the platen axis B. Often, the first fluid delivery arm 112 further includes a first delivery extension member 136 and a plurality of nozzles that include a first delivery nozzle 134. The plurality of nozzles are used to deliver polishing fluid or relatively high pressure streams of a cleaner fluid, e.g., deionized water, to one or more positions along the surface of the polishing pad 105.

Figure 3A:
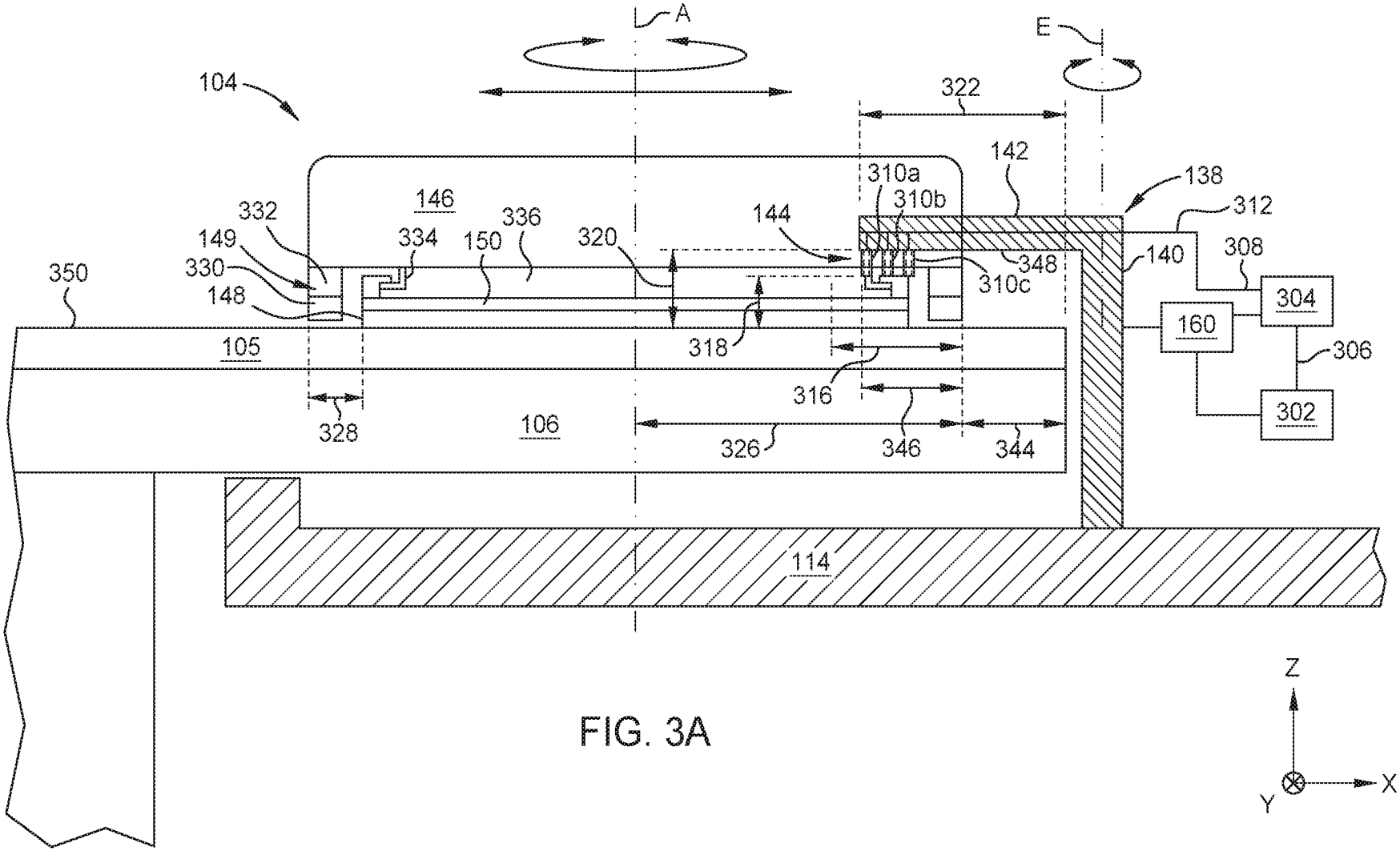
FIG. 3A is a schematic side view of a portion of the polishing system, of FIGS. 1 and 2.

As shown in the close up cross-sectional view of the substrate carrier assembly 104 and the second fluid delivery arm 138 of FIG. 3A, the substrate carrier assembly 104 features a carrier head 146, a carrier ring assembly 149 coupled to the carrier head 146, and a flexible membrane 150 disposed radially inward of the carrier ring assembly 149 to retain and urge the substrate 148 against the polishing pad 105 during processing. The carrier ring assembly 149 includes a lower annular portion and an upper annular portion, such as a substrate retaining ring 330 and a backing ring 332 respectively (FIG. 3A). The substrate retaining ring 330 is typically formed of a polymer which is bonded to the backing ring 332 using a bonding layer (not shown) disposed therein. The backing ring 332 is formed of a rigid material, such as a metal or ceramic, and is secured to the carrier head 146 using a plurality of fasteners (not shown). Examples of suitable materials used to form the substrate retaining ring 330 and the backing ring 332 respectively include any one or combination of the polishing fluid chemical resistant polymers, metals, and/or ceramics described herein. The flexible membrane 150 is typically coupled to the carrier head 146 using one or more annular membrane clamps 334 to collectively define a volume 336 therewith.

During substrate processing, the substrate retaining ring 330 surrounds the substrate 148 to prevent the substrate 148 from slipping from underneath the substrate carrier assembly 104. Typically, the volume 336 is pressurized during the polishing process to cause the flexible membrane 150 to exert a downward force on the substrate 148 while the substrate carrier assembly 104 rotates about the carrier axis A, thus urging the substrate 148 against the polishing pad 105. The carrier axis A may also be referred to herein as a rotational axis about which the substrate carrier assembly 104 is rotated during processing. Before and after polishing, a vacuum is applied to the volume 336 so that the flexible membrane 150 is deflected upwards to create a low pressure pocket between the flexible membrane 150 and the substrate 148, thus vacuum-chucking the substrate 148 to the substrate carrier assembly 104.

Generally, the inner diameter of the substrate retaining ring 330 is greater the diameter of the substrate 148 to allow for some clearance there between during the polishing process and substrate loading and unloading operations, such as greater than about 2 mm or more, or greater than about 3 mm or more. Similarly, the outer diameter of the substrate mounting surface of the flexible membrane 150 is less than the inner diameter of the substrate retaining ring 330 to allow the flexible membrane 150 to move relative thereto. The clearance between the substrate 148 and the substrate retaining ring 330 and between the flexible membrane 150 and the substrate retaining ring 330 creates a gap. Often, polishing fluid will accumulate between the edge of the substrate 148 and the substrate retaining ring 330.

Referring back to FIG. 1, the second fluid delivery arm 138 includes a second actuator 140, a base plate 114, a second delivery extension member 142, and a second delivery nozzle 144. The second actuator 140 enables movement about the second delivery arm axis E, such that the second delivery extension member 142 swings about the second delivery arm axis E. The second delivery extension member 142 is coupled to the second actuator 140 at a first distal end of the second delivery extension member 142. The second delivery nozzle 144 is disposed on the opposite end of the second delivery extension member 142, such that the second delivery nozzle 144 is disposed on a second distal end of the second delivery extension member 142. The second delivery nozzle 144 is pointed downwards towards the polishing pad 105. The second delivery nozzle 144 is configured to provide a fluid, such as either a polishing fluid or water onto the polishing pad 105 near the outside edge of the substrate carrier assembly 104.

The metrology unit 165 includes a measurement unit 162, a first opening 164 formed through the platen 106, a second opening 166 formed through the polishing pad 105 and a window 168 disposed within the second opening 166 within the polishing pad 105. The measurement unit 162 may be attached to the bottom of the platen 106 or may be disposed within the first opening 164. The measurement unit 162 is configured to measure the thickness of the substrate, including the substrate edge, and determine a removal rate across the substrate and the substrate edge during polishing. In some embodiments, the process of dispensing of the one or more liquids from the second fluid delivery arm is then controllable based upon the measured removal rate by the metrology tool. The measurement unit 162 may measure the thickness of the substrate edge by projecting radiation beams through the window 168 and onto the substrate 148 as the substrate passes over the window 168. The radiation beams are then reflected back to the measurement unit 162 and a thickness and/or removal rate at the edge of the substrate 148 is determined. The window 168 is an optically transparent window, such as a clear quartz window or transparent polymer.

The controller 160 is connected to each of the platen 106, the pad conditioner assembly 110, the metrology unit 165, the first fluid delivery arm 112, the second fluid delivery arm 138, and the substrate carrier assembly 104. In some aspects of the CMP polishing process, the controller 160 coordinates the rotation of the platen 106 as well as the dispensing of polishing fluid or water onto the polishing pad 105 by either of the first or second fluid delivery arms 112, 138. In some embodiments, the controller 160 uses the measurements from the metrology unit 165 to determine when fluid will be delivered to the polishing pad 105. The controller 160 also controls the movement of the substrate carrier assembly 104 and may increase or decrease the amount of pressure exerted onto the substrate 148 by the substrate carrier assembly 104.

Figure 2:
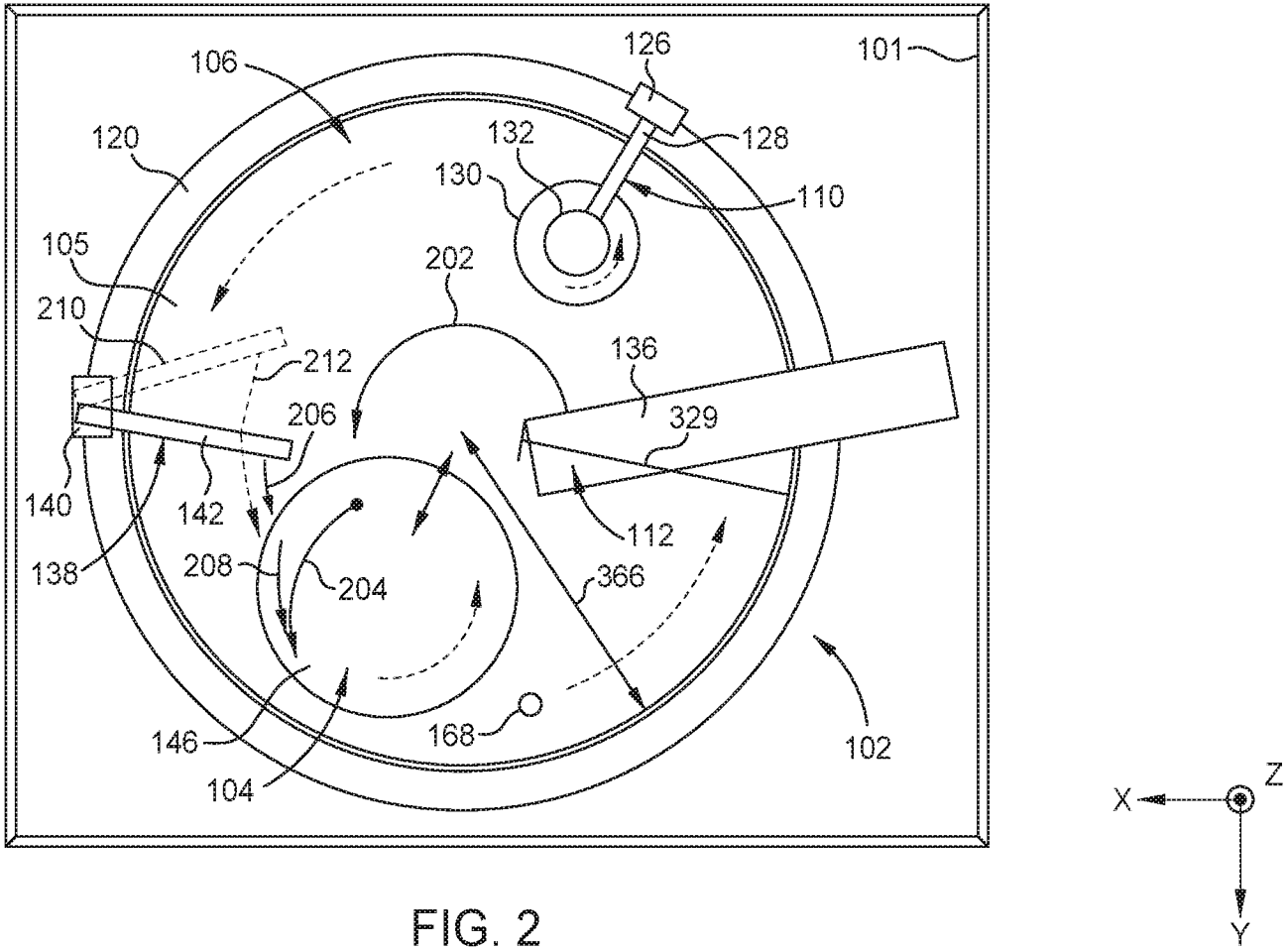
FIG. 2 is a schematic plan view of the polishing system of FIG. 1, according to one embodiment.

FIG. 2 is a schematic plan view of the polishing system 100 of FIG. 1, according to one embodiment. As discussed with reference to FIG. 1, each of the pad conditioner assembly 110, the first fluid delivery arm 112, the second fluid delivery arm 138, and the substrate carrier assembly 104 are disposed above the polishing pad 105. In one example, the polishing pad 105 is rotated in a counterclockwise direction by a rotation actuator (not shown) coupled to the platen 106 about the platen axis B (FIG. 1). The conditioner mounting plate 130 and the substrate carrier assembly 104 also typically rotate in a counterclockwise direction when viewed from above. In the embodiment of FIG. 2, each of the polishing pad 105, the conditioner mounting plate 130, and the substrate carrier assembly 104 rotate in the same direction. In some embodiments the polishing pad 105, the platen 106, the conditioner mounting plate 130, and the substrate carrier assembly 104 rotate in a clockwise direction. In some embodiments, one or more of the polishing pad 105, the platen 106, the conditioner mounting plate 130, and the substrate carrier assembly 104 rotate in a clockwise direction while the other components rotate in a counterclockwise direction.

The pad radius 366 of the polishing pad 105 is about 10 inches (254 mm) to about 30 inches (762 mm), such as about 12 inches (305 mm) to about 20 inches (508 mm), such as about 14 inches (356 mm) to about 16 inches (406 mm). In some embodiments, at least a portion of the first fluid delivery arm 112 is configured to deliver a fluid at a position that is at least 50% of the pad radius 366 of the polishing pad 105, such as over at least 60% of the pad radius 366 of the polishing pad, such as over at least 80% of the pad radius 366. In some embodiments, the first fluid delivery arm 112 is configured to deliver a fluid at a position that is at about 50% to about 90% of the pad radius 366 of the polishing pad 105, such as about 60% to about 85%. The first fluid delivery arm 112 is configured to deliver a fluid at a position that is at about 200 mm to about 360 mm inward over the polishing pad 105 from the edge of the polishing pad 105, such as about 210 mm to about 360 mm inward, such as about 225 mm to about 360 mm inward.

The first delivery extension member 136 of the first fluid delivery arm 112 is disposed over at least 50% of the pad radius 366 of the polishing pad 105, such as over at least 70% of the pad radius 366 of the polishing pad, such as over at least 80% of the pad radius 366. In some embodiments, the first delivery extension member 136 extends a first extension distance 329 over the polishing pad, such as greater than about 200 mm over the polishing pad 105, such greater than about 250 mm over the polishing pad 105, such as greater than about 300 mm over the polishing pad 105, such as greater than 380 mm over the polishing pad 105.

A first fluid, such as a polishing fluid, is delivered from one or more nozzles, such as the first delivery nozzle 134 of the first fluid delivery arm 112, and travels along a first fluid path 202. The first fluid path 202 is a path around the polishing pad 105 wherein the polishing fluid intersects the substrate carrier assembly 104 and the substrate 148 at an inner edge, such that the first fluid path 202 intersects the substrate carrier assembly 104 and the substrate 148 at an edge of the substrate carrier assembly 104 and the substrate 148, which is closer to the center of the polishing pad 105 and the platen axis B. In some embodiments, the first fluid delivered from the first delivery nozzle 134 intersects the substrate carrier assembly 104 less than about 230 mm from the platen axis B, such as less than about 200 mm from the platen axis B, such as less than about 150 mm from the platen axis B, such as less than about 100 mm from the platen axis B, such as less than about 50 mm from the platen axis B. The first fluid delivered from the first delivery nozzle 134 intersects the substrate carrier assembly 104 at least 20 mm from the platen axis B, such as at least 30 mm from the platen axis B. When the polishing fluid from the first delivery nozzle 134 is disposed between the polishing pad 105 and the substrate 148, the polishing fluid travels along the second fluid path 204, which further spreads the polishing fluid between the polishing pad 105 and the substrate 148.

The first fluid delivery arm 112 is configured to dispense the first fluid across a majority of the polishing pad 105, such that the first fluid delivery arm 112 dispenses fluid radially inward of the substrate carrier assembly 104 and the first fluid delivery arm 112 is configured to provide fluid to the polishing pad such that the dispensed fluid overlaps an entirety of a radial position occupied by the substrate carrier assembly 104 over the polishing pad 105. The first fluid delivery arm 112 dispenses a first fluid, such as a polishing fluid and/or a water onto the polishing pad 105 at a first radial position. The first radial position is a position radially inward from the innermost edge 380 (See FIG. 3B) of the substrate carrier assembly 104 with respect to the central axis B of the polishing pad 105.

The second fluid delivery arm 138 is also disposed over the polishing pad 105 and in some configurations is disposed on an opposite side of the platen 106 from the first fluid delivery arm 112. In one embodiment, the second fluid delivery arm 138 and the first fluid delivery arm 112 are disposed over opposite quadrants or halves (as shown in FIG. 2) of the polishing pad 105. The second fluid delivery arm 138 includes the second delivery extension member 142. The second fluid delivery arm 138 dispenses a second fluid, such as a polishing fluid and/or a water onto the polishing pad 105. The second fluid travels from the second delivery nozzle 144 along the third fluid path 206. The second fluid is dispensed onto the polishing pad 105 at a second radial position. The second radial position is a position radially outward from the innermost edge 380 (FIG. 3B) of the substrate carrier assembly 104 with respect to the central axis B of the polishing pad 105, but radially inward from the outermost edge 382 (FIG. 3B) of the substrate carrier assembly 104 with respect to the central axis B of the polishing pad 105. The third fluid path 206 extends between the second delivery nozzle 144 and an edge of the substrate carrier assembly 104. In some embodiments, the third fluid path 206 intersects an outermost edge 382 (FIG. 3B) of the substrate carrier assembly 104, such that the third fluid path 206 intersects an edge of the substrate carrier assembly 104 further from the center of the polishing pad 105 and closer to the edge of the polishing pad 105. Once the second fluid intersects the edge of the substrate carrier assembly 104 and the substrate 148, the second fluid travels along a fourth fluid path 208. The fourth fluid path 208 is generally a path along the outer edge of the substrate 148 and the substrate carrier assembly 104. The fourth fluid path 208 intersects the second fluid path 204, such that the first fluid and the second fluid mix. The second fluid is mixed with the first fluid to adjust the amount of the polishing fluids and composition of the polishing fluids near the edge of the substrate 148. In some embodiments, the mixture of the first fluid and the second fluid will either increase or reduce the amount of or concentration of one or more constituents of the first fluid across a portion of the substrate 148. In one example, the one or more constituents of the first fluid that may be adjusted by the addition of the second fluid includes the amount of and/or concentration of abrasive particles (e.g., silica-based abrasive, ceria-based abrasive, and alumina-based abrasive), water or other chemicals (e.g., acids, bases, inhibitors, etc.) across a portion of the substrate 148, such as the edge of the substrate 148.

The second fluid delivery arm 138 is moveable about a second delivery axis E (FIG. 1). The second fluid delivery arm 138 rotates about the second delivery axis E to change the position of the second delivery nozzle 144 over the polishing pad 105. The second fluid delivery arm 138 can be moved to and from a first position and a second position. In one example, the second position 210 creates an alternative fluid path 212 to a third fluid path 206 created by the position of the second delivery extension member 142. As illustrated in FIG. 2, the fluid path 212 is positioned at a different radial position from the third fluid path 206. The second fluid delivery arm 138 is moved to the second position 210 to allow for the third fluid path 206 to be adjusted to the alternative fluid path 212 or another fluid path 212. As the substrate carrier assembly 104 moves across the polishing pad, such as along the pad radius 366 of the polishing pad, the movement of the second fluid delivery arm 138 may be synchronized with the movement of the substrate carrier assembly 104 to keep a similar radial entry point for the second fluid along the outer circumference of the substrate carrier assembly 104. Alternatively, the second fluid delivery arm 138 is moveable to allow for the radial entry point along the outer circumference of the substrate carrier assembly 104 to be adjustable throughout the process.

In addition to the second position 210 shown in FIG. 2, it is envisioned that the second fluid delivery arm 138 may be moved to a range of positions over the polishing pad 105 by use of the second actuator 140 and controller 160. In some embodiments, it is envisioned that the second fluid delivery arm 138 may have the ability to rotate in a half circle about the second delivery axis E, such that the second fluid delivery arm 138 can rotate by about 180 degrees. In yet other embodiments, the second fluid delivery arm 138 may rotate by less than 180 degrees, such as less than about 120 degrees, such as less than about 90 degrees. In some embodiments, the second fluid delivery arm 138 is configured to rotate to positions wherein the second delivery nozzle 144 is always disposed over the polishing pad 105 during polishing operations.

FIG. 3A is a schematic side view of a portion of the polishing system 100, of FIGS. 1 and 2. FIG. 3A more specifically illustrates a side close up view of the substrate carrier assembly 104 and the second fluid delivery arm 138. The carrier head 146, the carrier ring assembly 149, the flexible membrane 150, the polishing pad 105, the platen 106, and the substrate 148 are described above. The substrate 148 is shown pressed against the polishing pad 105 by the flexible membrane 150. The flexible membrane 150 typically applies an adjustable amount of pressure to the substrate 148 during polishing to improve the planarization of the surface of the substrate. The flexible membrane 150 is coupled to the substrate carrier assembly by membrane clamps (not shown).

A temperature control unit 304 and a fluid source 302 are fluidly connected to the second fluid delivery arm 138. The temperature control unit 304 and fluid source 302 are connected to and controlled by the controller 160. The fluid source 302 supplies one or more fluids to the second fluid delivery arm 138 to be dispensed onto the polishing pad 105. The fluid source 302 includes one or more fluid sources that are configured to provide a polishing fluid and a water. The sources of fluid provided from the fluid source 302 are each configured to provide their respective fluids at a desired flow rate and pressure. The polishing fluid source may provide one or more fluids that include a chemical solution (e.g., acid, base, inhibitor, etc.) and/or slurry containing solution (e.g., abrasive particle (e.g., silica, ceria, or alumina based abrasives) containing solution) used for substrate polishing. The water source is a de-ionized water source. The fluid source 302 may include a pump or a plurality of pumps (one for each fluid).

The fluid source 302 is fluidly connected to the temperature control unit 304 by a first conduit 306. In some embodiments, the temperature control unit 304 may be integrated into the fluid source 302 and the first conduit 306 is removed. The temperature control unit 304 controls the temperature of the fluids being delivered to the second fluid delivery arm 138 before they reach the second fluid delivery arm 138. The temperature control unit 304 may include resistive heating elements therein for heating of the fluids disposed therein. The temperature control unit 304 may also include cooling channels disposed therein for cooling the fluids or for cooling the heating elements. The temperature control unit 304 may heat or cool the fluids to temperatures suitable to enhance or inhibit the CMP polishing process. It is believed that by controlling the temperature of the fluids supplied to a first region of a substrate during a polishing process, along with the other CMP process control variables discussed herein (e.g., amount of a fluid, concentration of fluid components, applied pressure, etc.), the chemical activity and/or interaction of the abrasive particles with the surface of the substrate can be adjusted to adjust the removal rate in the first region of the substrate versus other regions of the substrate. The temperature control unit 304 is disposed external from the second fluid delivery arm 138 to reduce the volume occupied by the second fluid delivery arm 138 and reduce the impact of the heating or cooling on the volume surrounding the second fluid delivery arm 138.

The temperature control unit 304 is fluidly connected to the second fluid delivery arm 138 by the second conduit 308. The second conduit extends between the temperature control unit 304 and the second fluid delivery arm 138. Once the fluid reaches the second fluid delivery arm 138, the fluid is transferred through the second fluid delivery arm 138 by a third conduit 312. The third conduit extends through the second fluid delivery arm 138 and fluidly connects the second fluid delivery arm 138 to the second delivery nozzle 144. The second conduit 308 and the third conduit 312 may both be insulated to reduce the heat loss of the fluid as the fluid travels from the temperature control unit 304 to the second delivery nozzle 144.

In some embodiments, each of the first conduit 306, the second conduit 308, and the third conduit 312 comprise two or more conduits, such that a first fluid, such as a polishing fluid, is provided through one of the sets of conduits and a second fluid, such as a water, is provided through a second set of conduits. The first and second set of conduits may be connected in parallel and pass from the fluid source 302 into the temperature control unit 304 separately and separately from the temperature control unit 304 into the second fluid delivery arm 138 before being separately provided to one or more of the second delivery nozzles 144. Thus, in some embodiments that include the delivery of multiple fluids, each of the fluids may be delivered and travel along multiple conduits (a different conduit for each type of fluid), so that the temperature control unit 304 can separately adjust the temperature of each of the multiple conduits to the same or different temperatures.

As noted above, the second delivery nozzle 144 may comprise a plurality of nozzles, such as a first nozzle 310*a*, a second nozzle 310*b*, and a third nozzle 310*c*. The first, second, and third nozzles 310*a*, 310*b*, 310*c* are disposed along a bottom surface 348 of the second delivery extension member 142, such as a bottom surface of the second delivery extension member 142. The first, second, and third nozzles 310*a*, 310*b*, 310*c* may be angled to project fluid delivered through the first, second, and third nozzles 310*a*, 310*b*, 310*c* in a direction other than a vertical direction (Z-direction) that is perpendicular to the top surface 350 of the polishing pad 105. Although shown as disposed along a plurality of radial positions in FIG. 3A, the plurality of nozzles could also be disposed at positions with the same radial distance along the second delivery extension member 142 from the second delivery axis E, such that each of the first, second, and third nozzles 310*a*, 310*b*, 310*c* project fluid onto a similar radial position of the polishing pad 105. Although three nozzles are depicted as the second delivery nozzle 144 herein, it is envisioned that other quantities of nozzles may also be utilized, such as two nozzles, four nozzles, five nozzles, or six nozzles, so that one or more different fluids can be provided to the surface of the polishing pad 105.

The separation distance 318 between the bottom of the first, second and third nozzles 310*a*, 310*b*, 310*c* and the top surface 350 of the polishing pad 105 is about 5 mm to about 120 mm, such as about 10 mm to about 100 mm, such as about 10 mm to about 50 mm. The separation distance 320 between the bottom surface 348 of the second delivery extension member 142 and the top surface 350 of the polishing pad 105 is about 10 mm to about 160 mm, such as about 10 mm to about 150 mm, such as about 10 mm to about 100 mm, such as about 10 mm to about 50 mm. The separation distance 320 is greater than about 10 mm to avoid the fluid meniscus on the pad from contacting the second delivery extension member 142.

In one example, each of the first, second, and third nozzles 310*a*, 310*b*, 310*c* are configured to deliver different fluids. In another example, the first, second, and third nozzles 310*a*, 310*b*, 310*c* are configured to dispense both a first and a second fluid at the same time or sequentially in time, such as a polishing fluid and a water. In some embodiments, the first nozzle 310*a* is configured to dispense a polishing fluid, while the second and third nozzles 310*b*, 310*c* are configured to dispense water. In one example, the first nozzle 310*a* is configured to dispense a polishing fluid, while the second and third nozzles 310*b*, 310*c* are configured to dispense water that is provided at a different temperature and/or flow rate from each nozzle. In some embodiments, the first nozzle 310*a* is configured to dispense water, while the second and third nozzles 310*b*, 310*c* are configured to dispense a polishing fluid. In one example, the first nozzle 310*a* is configured to dispense water, while the second and third nozzles 310*b*, 310*c* are configured to dispense a different polishing fluid at the same or a different temperature and/or flow rate from each nozzle. In some embodiments, there may be multiple types of polishing fluids and each of the polishing fluids are dispensed from a different nozzle at a desired temperature and flow rate.

It is possible to dispense both a water and a polishing fluid simultaneously or separately. In some embodiments, while a water is dispensed from a first nozzle 310*a*, the second and third nozzles 310*b*, 310*c* dispense polishing fluid simultaneously. In other embodiments, the polishing fluid is dispensed from the first nozzle 310*a* and the second and third nozzles 310*b*, 310*c* dispense a water simultaneously. Alternatively, the polishing fluid and the water would be dispensed at separate times. In yet other embodiments, the water and the polishing fluid are mixed before reaching the first, second, and third nozzles 310*a*, 310*b*, 310*c* to alter the concentration of the polishing fluid before being dispensed onto the polishing pad 105. In embodiments in which the water and polishing fluid are pre-mixed, the water and polishing fluid may be mixed in any of the fluid source 302, the temperature control unit 304, or within the conduits 306, 308, 312.

The substrate carrier assembly 104 has a carrier radius 326 of about 110 mm to about 260 mm, such as about 155 mm to about 175 mm. The outermost edge 382 (FIG. 3B) of the substrate carrier assembly 104 is a carrier edge distance 344 from the edge of the platen 106. The carrier edge distance 344 is about 1 mm to about 50 mm, such as about 2 mm to about 40 mm, such as about 3 mm to about 35 mm. The carrier edge distance 344 may vary as the substrate carrier assembly 104 is moved across the polishing pad 105 (e.g., along the pad radius 366 and over the platen 106) during processing. In some embodiments, the polishing pad 105 is slightly larger than the platen 106. If the polishing pad 105 and the platen 106 are the same size, the carrier edge distance 344 may be measured from either the outer edge of the polishing pad 105 or the outer edge of the platen 106. The substrate carrier assembly 104 typically oscillates within about a range of less than 26 mm along the pad radius 366.

The distance 328 between the outer edge of the substrate 148 and the outermost edge 382 (FIG. 3B) of the substrate carrier assembly 104 is about 20 mm to about 35 mm, such as about 25 mm to about 30 mm. The outer edge of the substrate carrier assembly 104 is the outer edge of the substrate retaining ring 330. The distance 328 may vary slightly during processing as the substrate 148 shifts position within the substrate carrier assembly 104. At some moments, the substrate 148 is in contact with the inner edge of the substrate retaining ring 330, such that the distance 328 between the outer edge of the substrate 148 and the outer edge of the substrate carrier assembly 104 is approximately equal to the thickness of the substrate retaining ring 330.

The substrate carrier assembly 104 can be disposed at various radial positions on the polishing pad 105 as the polishing pad 105 rotates, such that the substrate carrier assembly 104 can be disposed over and travels within an annular portion or band of the polishing pad 105. The radial portion of the polishing pad 105 in which the substrate carrier assembly 104 is disposed is at least 10% of the total radius of the polishing pad 105 from the center of the polishing pad 105 and no more than 90% of the total radius of the polishing pad 105 from the center of the polishing pad 105, such as at least 15% of the total radius of the polishing pad 105 from the center of the polishing pad 105 and no more than 85% of the total radius of the polishing pad 105 from the center of the polishing pad 105. In some alternative embodiments, the substrate carrier assembly 104 may travel over the central axis of the polishing pad and the platen and outward of the outer edge of the polishing pad 105, such that the substrate may be disposed over the center of the polishing pad or partially hanging over the edge of the polishing pad 105.

The second fluid delivery arm 138 extends over the polishing pad 105 and the platen 106. The second actuator 140 of the second fluid delivery arm is coupled to the base plate 114. The second delivery extension member 142 is coupled to a distal end of the second actuator 140 and disposed over the polishing pad 105 in a horizontal direction. The second delivery extension member 142 extends an extension distance 322 over the polishing pad 105. The extension distance 322 can be less than 255 mm, such that the second delivery extension member 142 extends over less than 250 mm of the polishing pad 105 when polishing a 300 mm substrate, such as less than 230 mm, such as less than 118 mm. In some embodiments, the second fluid delivery arm 138 is disposed over the outer portion of the polishing pad 105 and at least 170 mm outward from the platen axis B, such as at least 160 mm outward from the platen axis B, such as at least 155 mm outward from the platen axis B. Alternative substrate sizes may also be utilized, such as 200 mm or 450 mm substrates. In embodiments with alternative substrate sizes, in addition to the 300 mm substrate, the second delivery extension member 142 is also able to be measured as extending over less than 75% of the pad radius 366 of the polishing pad 105, such as less than 60% of the pad radius 366, such as less than 55% of the pad radius 366, such as less than 50% of the pad radius 366. The second delivery extension member 142 extends over the outer portion of the polishing pad 105, such that the second fluid delivery arm overlaps a portion of the polishing pad radius.

The second delivery extension member 142 and the substrate carrier assembly 104 are both disposed over an overlapping radial distance along the radius of the polishing pad 105, referred to herein as an overlapping portion 346, of the polishing pad 105. In some embodiments, the overlapping portion 346, as measured across the polishing pad 105, is less than the diameter of the substrate carrier assembly 104, such that the overlapping portion 346 is less than 200% of the carrier radius 326, such as less than 190% of the carrier radius 326, such as less than 180% of the carrier radius 326, such as less than 150% of the carrier radius 326, such as less than 100% of the carrier radius 326. In some embodiments, the overlapping radius 346 is less than 380 mm, such as less than 360 mm, such as less than 300 mm, such as less than 200 mm, such as less than 180 mm, such as less than 155 mm. In some embodiments, the overlapping radius 346 is greater than half of the carrier radius 326. In other embodiments, the overlapping radius 346 is less than half of the carrier radius 326, such that the fluid delivered by the second fluid delivery arm is delivered to a position on the polishing pad 105 that coincides with the outer radius of the substrate carrier assembly 104, which is positioned near the outer edge of the polishing pad 105. In embodiments described herein the first fluid delivery arm 112 and the first delivery extension member 142 (FIG. 2) extend over a greater length along the pad radius 366 radius of the polishing pad 105 and the platen 106 than the second delivery extension member 142 and the second fluid delivery arm 138, such that the first fluid delivery arm 112 extends further towards the central axis B of the platen 106 than the second fluid delivery arm 138.

The second delivery nozzle 144 delivers fluid to the top surface 350 of the polishing pad 105 at a spray region 316 that is disposed a distance from the center of the polishing pad 105 and the carrier axis A. The spray region 316 is an annular region disposed about the carrier axis A. The spray region 316 in some embodiments may be configured to be anywhere along the radius of the polishing pad 105, but in other embodiments is disposed between the carrier axis A and the outer edge of the substrate carrier assembly 104.

Figure 3B:
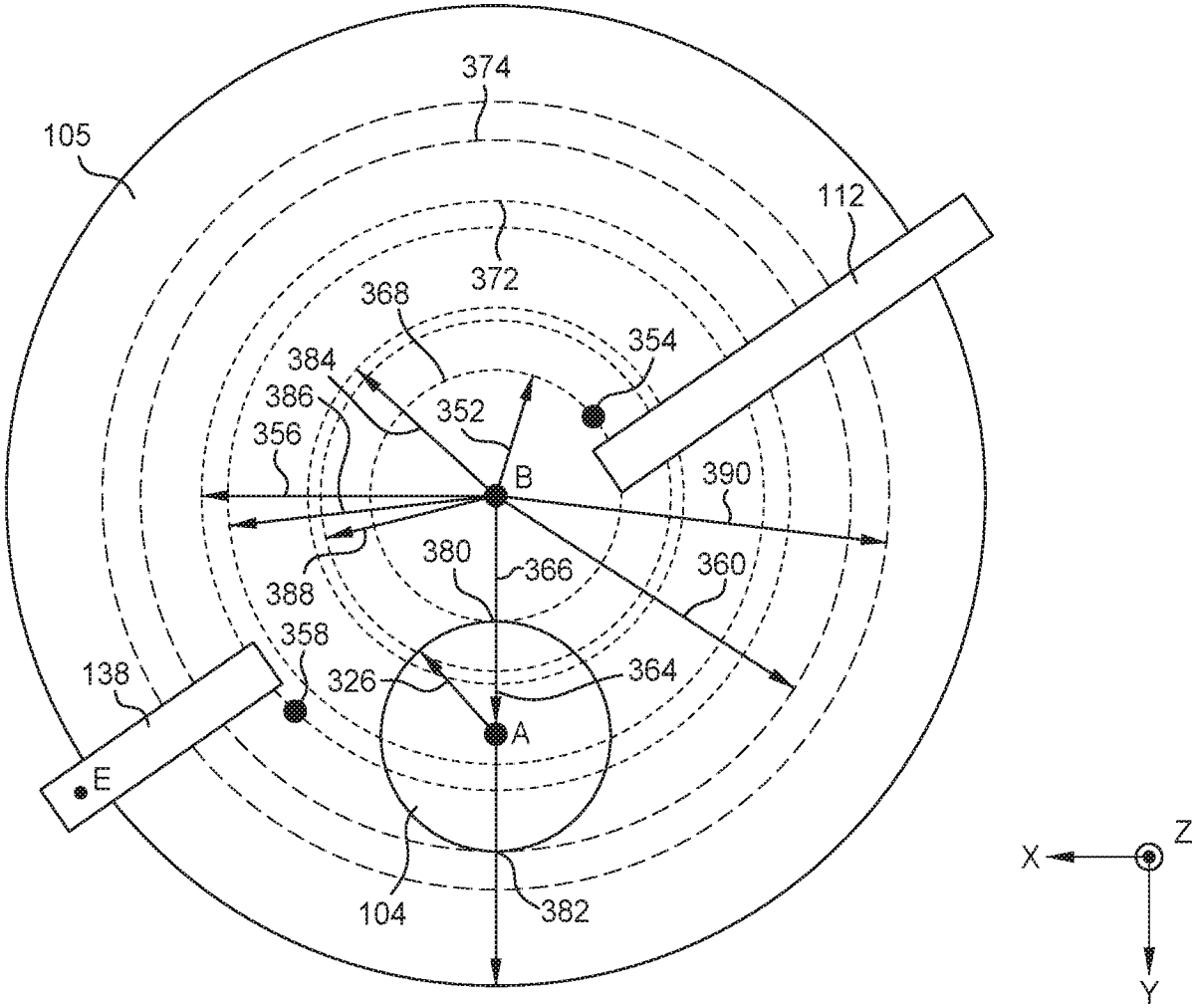
FIG. 3B is a simplified schematic plan view of a portion of the polishing system of FIG. 3A.

FIG. 3B is a simplified schematic plan view of a portion of the polishing system 100 of FIG. 3A. The polishing pad 105 is shown and is simplified by not showing the pad conditioner assembly 110 (FIG. 2). The first fluid delivery arm 112 dispenses fluid to a first point 354 on the polishing pad 105. The first point 354 is disposed on a first annular ring 368 centered about the central axis B. The second fluid delivery arm 138 dispenses fluid to a second point 358. The second point 358 is disposed on a second annular ring 372 centered about the central axis B.

The carrier axis A of the substrate carrier assembly 104 is disposed a first radial distance 364 from the central axis B of the polishing pad 105. The first radial distance 364 is about 40% to about 60% of the pad radius 366, such as about 45% to about 55% of the pad radius 366. In embodiments configured to polish a 300 mm substrate, the first radial distance 364 is about 175 mm to about 250 mm, such as about 190 mm to about 240 mm.

The first point 354 is disposed a second radial distance 352 from the central axis B of the polishing pad 105. In some configurations, the second radial distance 352 is about 5% to about 20% of the polishing pad radius 366, such as about 10% to about 15% of the polishing pad radius 366. For a 300 mm substrate polishing system, the second radial distance 352 is about 40 mm to about 175 mm, such as about 50 mm to about 150 mm. The second point 358 is disposed a third radial distance 356 from the central axis B of the polishing pad 105. In some configurations, the third radial distance 356 is greater than about 30% of the polishing pad radius 366 from the central axis B, such as about 30% to about 90% of the polishing pad radius 366, such as about 40% to about 90% of the polishing pad radius 366, such as about 60% to about 80% of the polishing pad radius 366. For a 300 mm substrate polishing system, the third radial distance 356 is about 125 mm to about 375 mm, such as about 150 mm to about 350 mm.

In some embodiments, the first point 354 is disposed radially inward of the innermost edge 380 of the substrate carrier assembly 104. The outermost edge 382 of the substrate carrier assembly 104 is disposed at or radially inward of a fourth radial distance 360 from the central axis B of the polishing pad 105. The outermost edge 382 stays within a third annular ring 374. The third annular ring 374 is an annular portion centered about the central axis B of the polishing pad. The third annular ring 374 is has a radius of a fourth distance, such that the third annular ring 374 is a fourth radial distance 360 from the central axis B. In some embodiments, the fourth radial distance 360 is about 85% to about 99% of the polishing pad radius 366, such as about 90% to about 99% of the polishing pad radius 366. In embodiments in which the polishing system is configured to polish a 300 mm substrate, the fourth radial distance 360 is about 325 mm to about 450 mm, such as about 350 mm to about 425 mm. However, in other embodiments, the fourth radial distance 360 may be greater than the radius of the polishing pad 105, such that the substrate carrier assembly 104 may sometimes be disposed over an edge of the polishing pad 105.

The second annular ring 372 is disposed between the first annular ring 368 and the third annular ring 374, such that the second point 358 at which fluid is dispensed from the second fluid delivery arm 138 is between the innermost edge 380 and the outermost edge 382, such that the second point 358 passes underneath the substrate carrier assembly 104 as the polishing pad 105 is rotated. Therefore, the second point 358 is at a position between the second radial distance 352 and the fourth radial distance 360.

The second point 358 additionally is found between the second radial distance 352 and the fourth radial distance 360 even as the substrate carrier assembly 104 oscillates (described below). The oscillation of the substrate carrier assembly 104 may change the second point 358, such that the second point 358 still passes underneath a portion of the substrate carrier assembly 104. The second radial distance 352 and the fourth radial distance 360 are shown as fixed distances within FIG. 3B, but are generally understood to vary as the substrate carrier assembly 104 oscillates.

As described above, the substrate carrier assembly 104 is moved by a first actuator, such as the first actuator 170 of FIG. 1. The first actuator 170 is configured to move the substrate carrier assembly 104 in either a radial, an arcuate, or both a radial and arcuate direction. In embodiments in which the radial position of the substrate carrier assembly 104 is changed throughout a polishing process, the carrier axis A may oscillate between two radial distances from the central axis B of the polishing pad 105, such that the first radial distance 364 varies between the two radial distances. The first radial distance 364 oscillates between a first radial value 384 and a second radial value 386. The first radial value 384 is about 175 mm to about 180 mm, such as about 176 mm to about 178 mm. The second radial value 386 is about 200 mm to about 205 mm, such as about 202 mm to about 204 mm. The second radial value 386 is greater than the first radial value 384.

As described above, the second actuator 140 enables the rotation of the second fluid delivery arm 138 about the second delivery axis E. The second delivery axis E rotates the second fluid delivery arm 138 such that the innermost portion of the second fluid delivery arm 138 may oscillate between a third radial value 388 and a fourth radial value 390. In some embodiments it is the second delivery nozzle 144 (FIG. 3A) which oscillates between the third radial value 388 and the fourth radial value 390. The fourth radial value 390 is greater than the third radial value 388 as well as the first radial value 384 and the second radial value 386. The third radial value 388 is about 145 mm to about 250 mm, such as about 150 mm to about 225 mm. The fourth radial value 390 is about 340 mm to about 380 mm, such as about 350 mm to about 370 mm.

Figure 4:
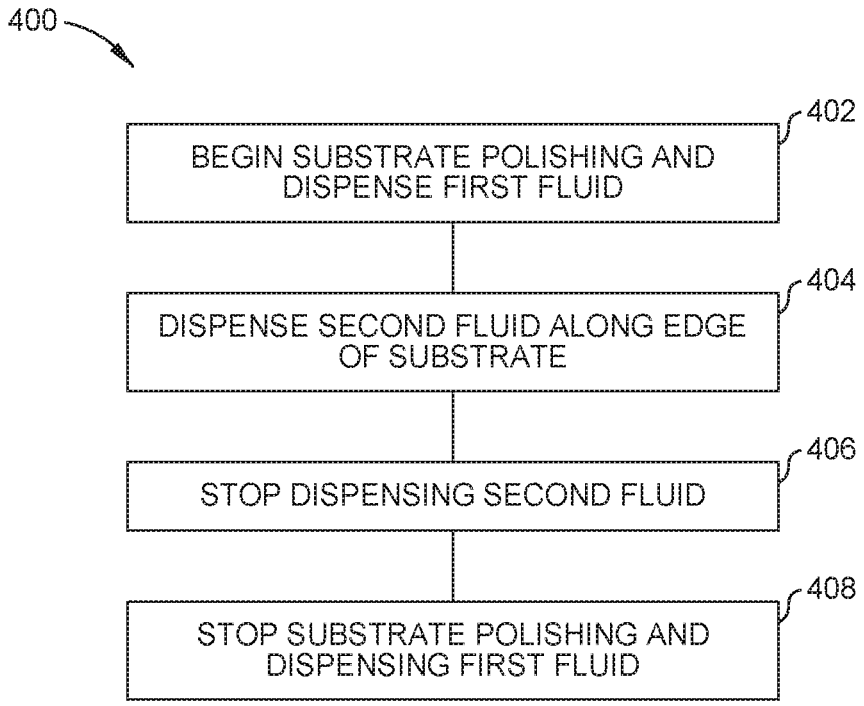
FIG. 4 is a diagram illustrating a method of dispensing one or more fluids within the polishing system of FIGS. 1-3.

FIG. 4 is a diagram illustrating a method 400 of dispensing polishing fluid from the polishing system 100 of FIGS. 1-3. The method 400 includes a first operation 402, a second operation 404, a third operation 406, and a fourth operation 408. Although depicted in a sequential order herein, the operations within the method 400 may be amended to be performed in alternative orders, at the same time and/or additional operations may be included.

The first operation 402 includes beginning to polish a substrate, such as the substrate 148 and dispensing a first fluid from a first fluid delivery arm, such as the first fluid delivery arm 112 disclosed in FIGS. 1 and 2. The first fluid is provided at a first flow rate and at a first temperature to the surface of the polishing pad. The substrate is held by a substrate carrier assembly 104 and pressed into a polishing pad, such as the polishing pad 105 disclosed herein. In this example, the polishing pad is rotated in a counterclockwise direction. The substrate carrier assembly 104 may also rotate in a counterclockwise direction while oscillating along the radius of the polishing pad. The first fluid is dispensed from one or more nozzles along the first fluid delivery arm at a radius of the polishing pad which is typically in the inner 50% of the radius of the polishing pad.

The first fluid is a polishing fluid for polishing the substrate. The polishing fluid includes a slurry and/or chemical containing mixture, which may include particles suspended therein to aid in polishing the substrate. The first fluid is delivered within the inner half of the radius of the polishing pad and flows along a first fluid path. In some embodiments, the first fluid is dispensed onto a location of the polishing pad which is radially inward of the substrate carrier assembly with respect to the central axis B of the polishing pad. In some embodiments, the first fluid is delivered at a position so that the first fluid interacts with the entirety of the substrate surface as the first fluid moves outward along the rotating polishing pad. The first fluid moves outward along the polishing pad due to the rotation of the polishing pad and centrifugal forces imparted on the first fluid. As the fluid moves outward along the polishing pad, the first fluid may be said to be traveling downstream, such that the first fluid is delivered at an upstream position and flows downstream and radially outward from the center of the polishing pad and towards the edge of the polishing pad.

The substrate carrier assembly holds the substrate thereunder and includes a substrate retaining ring thereunder. In some processes, the substrate retaining ring assists in keeping the substrate from sliding out from underneath the substrate carrier assembly. The substrate retaining ring therefore sometimes contacts the edge of the substrate and can cause non-uniform removal rates during the polishing process along the edge of the substrate. A buildup of the first fluid at one or more regions of the substrate surface and the substrate retaining ring may occur. The buildup of the first fluid also impacts the removal rate at the one or more regions of the substrate surface, such as near the edge of the substrate. The buildup of the polishing fluid at different regions of the substrate surface may cause either an increase or a decrease in the removal rate near the edge of the substrate. In one exemplary embodiment, a decrease in removal rate may be caused by the creation of a barrier layer between the affected substrate region (e.g., substrate edge) and the polishing pad. In yet another exemplary embodiment, the build up of polishing fluid may increase the removal rate by exposing the substrate to a larger quantity of polishing chemicals. The inverse may also be true in that a reduction in the buildup of the polishing fluid near the edge of the substrate may either increase the removal rate or decrease the removal rate depending upon the application and the polishing fluid utilized. Therefore, a second fluid, such as deionized water or additional polishing fluid, may be dispensed onto the polishing pad and configured to interact with the first fluid near the edge of the substrate. The second fluid may either thin or thicken the polishing fluid buildup near the edge of the substrate.

During processing, the carrier assembly is translated across a surface of the pad while rotating the carrier assembly about the carrier axis. Translating the carrier assembly across the surface of the pad causes a first radial distance measured from the central axis to the rotational axis to vary between a first radial value and a second radial value as the carrier assembly is translated across the surface of the pad.

A pad conditioner assembly, such as the pad conditioner assembly 110, may be used during the first operation 402 to clean or rejuvenate the polishing pad. The pad conditioner assembly rotates in a counterclockwise direction along with the substrate carrier assembly and the polishing pad. The pad conditioner assembly is disposed over the polishing pad and physically contacts the polishing pad as the pad conditioner assembly moves across the polishing pad.

The second operation 404 is generally performed subsequent the first operation 402, but in some embodiments may be performed first or simultaneously. The second operation 404 includes dispensing one or more second fluids from a second fluid delivery arm, such as the second fluid delivery arm 138. The one or more second fluids are provided at a second flow rate and at a second temperature to the surface of the polishing pad. The second fluids may be different fluids from the first fluids. The first and second flow rates and first and second temperatures of the first and second fluids, respectively, may be the same or each be different. The second fluid is dispensed to a position on the polishing pad to intersect a desired portion of the substrate, which is, for example, about 140 mm outward, such as about 150 mm outward from a central axis B of the polishing pad. In some embodiments, the second fluid is dispensed to an outer area of the polishing pad, such that the second fluid is delivered to a portion of the substrate via the polishing pad that is at least greater than 35% of the radius of the polishing pad from the central axis B of the polishing pad, such as greater than about 40% of the radius of the polishing pad from the central axis B of the polishing pad, such as between about 40% and about 95% of the radius of the polishing pad from the central axis B of the polishing pad, such as between about 40% and about 90% of the radius of the polishing pad from the central axis B of the polishing pad. The second fluid is dispensed from one or more nozzles along the second fluid delivery arm and impacts the polishing pad along a spray region 316, as described above. The second fluid flows along the second fluid path. The beginning of the second fluid path is outward from the beginning of the first fluid path, such that the second fluid path is dispensed outward of the point at which the first fluid is dispensed with respect to the central axis B. The second fluid intersects the carrier assembly and the first and second fluid mix underneath the carrier assembly.

The mixture of the first and second fluids may change the characteristics of the fluid near the edge of the substrate. The second fluid may be any one of a polishing fluid or a water. As described above, the polishing fluid may include a chemical and/or a slurry. In some embodiments, a polishing fluid is dispensed from the second fluid delivery arm as the second fluid to increase the amount of polishing fluid near the edge of the substrate. In some embodiments, water is dispensed from the second fluid delivery arm as the second fluid to adjust one or more characteristics of the first fluid provided from the first delivery arm. In some cases, the second fluid, which includes water, is provided to reduce the amount of polishing fluid near the edge of the substrate, control the temperature and/or concentration of the combined first fluid and second fluid, and/or to thin the polishing fluid which may have built up near the edge of the substrate.

In some embodiments, the substrate carrier assembly and the second fluid delivery arm are both moveable and move during the second operation 404. The substrate carrier assembly moves along the top surface of the polishing pad and moves the substrate to different positions along the polishing pad. The second fluid delivery arm may be controlled to track the movement of the substrate carrier assembly while the substrate carrier assembly moves. The second fluid delivery arm may track the substrate carrier assembly by moving with the substrate carrier assembly.

In some embodiments, the second fluid delivery arm is configured to move so that a radial location at which fluids dispensed from the second fluid delivery arm intersect the substrate carrier assembly at the same location, such that dispensed fluid intersects the substrate at the same radial position on the substrate as the substrate carrier assembly moves. In this embodiment, the second fluid delivery arm would always deliver the second fluid to a similar radius of the substrate carrier assembly from the center of the substrate carrier assembly. This tracking may include the swinging of the second fluid delivery arm about the axis E to either extend further over the polishing pad or reduce the amount of extension over the polishing pad.

In some embodiments, the second fluid delivery arm is configured to move so that the fluid path caused by the delivery of fluid from the second fluid delivery arm intersects the substrate carrier assembly at the same relative position on the substrate carrier assembly at all times. In this embodiment, the rotation of the second fluid delivery arm about the axis E is controlled so that the end of the fluid path of the fluid from the second fluid delivery arm consistently intersects the substrate carrier assembly at a similar radial and angular position relative to the carrier axis A.

The type of second fluid dispensed by the first delivery arm and second fluid delivery arm is dependent upon the material being polished from the substrate. In embodiments in which oxides are being polished by the polishing system, the temperature of the second fluid may be controlled by a temperature control unit, such as the temperature control unit 304.

The second operation 404 may include simultaneous dispensing of the first fluid or the dispensing of the first fluid may be halted during the second operation 404. Even if the dispensing of the first fluid is halted, the rotation of the polishing pad and the substrate carrier assembly is maintained. In some embodiments, the rotational velocity of the polishing pad and/or the substrate carrier assembly is decreased or increased during the second operation, but the rotation will continue without halting of the polishing pad or the substrate carrier assembly.

A metrology unit, such as the metrology unit 165, may measure the thickness of the substrate to estimate the rate of removal caused by polishing. The metrology unit is connected to a controller and the controller can determine an appropriate amount of second fluid and the temperature of the second fluid to be utilized if any second fluid is used, such that the controller determines a dispensing rate from the second fluid delivery arm based upon the measured thickness of the substrate. In some embodiments, the temperature of the second fluid is increased to increase the polishing rate at the edge of the substrate. In other embodiments, the temperature of the second fluid is decreased to decrease the polishing rate at the edge of the substrate. The metrology unit may be an inductive metrology unit (e.g. eddy current) or a spectral metrology unit (e.g., optical metrology).

In some operations, the metrology unit is not utilized and the second fluid is instead dispensed on a timed sequence, such that the second fluid is dispensed at set intervals during the polishing process. In some embodiments, the second fluid is dispensed continuously, but the flow rate and/or temperature of the second fluid is adjusted over time.

The third operation 406 includes stopping the dispensing of the second fluid. The dispensing of the second fluid by the second fluid delivery arm is stopped either permanently or periodically. In some embodiments, the dispensing of the second fluid is stopped in the third operation 406 and the controller beings the dispensing of the second fluid in the second operation 404 again. The second operation 404 and the third operation 406 may be repeated or looped. The second operation 404 is repeated after the third operation 406 if the removal rate near the substrate edge begins to deviate from a pre-set range. The removal rate may be measured using the metrology unit. In some embodiments, the controller may determine the frequency and number of times the second operation 404 and the third operation 406 are looped to accomplish a desired polishing result. The progress of the polishing is determined using the metrology unit. Alternatively, the frequency and process parameters of repeating the second operation 404 and the third operation 406 are determined experimentally so that the second operation 404 and the third operation 406 are repeated a pre-set number of times.

The fourth operation 408 includes stopping the substrate polishing and the dispensing of the first fluid. The fourth operation 408 is performed after each of the first, second, and third operations 402, 404, 406 have been completed. The substrate polishing and the dispensing of the first fluid are stopped once the polishing operation being performed on the substrate has been completed.

Embodiments disclosed herein relate to a second fluid delivery arm configured to deliver a second fluid to a polishing pad within a CMP system. The second fluid delivery arm is different from the first fluid delivery arm in that the second fluid delivery arm is configured to dispense fluid to the edges of the substrate while having significantly reduced impact on the amount of polishing fluid near the center of the substrate. In some embodiments, the fluid delivered by the second fluid delivery arm would only significantly impact the polishing rate of the outer 10 mm of the substrate, such that for a 300 mm diameter substrate, the polishing rate at the outermost 10 mm of the substrate would be impacted, but the inner 140 mm would have substantially unchanged polishing rates.

The processes used within the disclosure above may vary depending upon the type of polishing process. Some polishing processes may utilized the temperature control unit and the metrology unit, while other processes may not utilize the temperature control unit or the metrology unit. Similarly, some polishing processes utilize an automated dispense process based upon previous experimental results and do not utilize a metrology unit. If the polishing processes described herein are related to an oxide polishing process, the temperature control unit and the metrology unit may be utilized. If the polishing processes described herein are related to a metal polishing process, the process may be automated and the controller may dispense the second fluid at pre-determined intervals without the use of a metrology unit. While as described above the temperature control unit and the metrology unit is primarily utilized during oxide polishing processes, it is contemplated the temperature control unit and the metrology unit may also be utilized with metal processes, such as a tungsten polishing process.

While the foregoing is directed to embodiments of the present disclosure, other and further embodiments of the disclosure may be devised without departing from the basic scope thereof, and the scope thereof is determined by the claims that follow.

What is claimed is:

1. An apparatus for processing a substrate, comprising:

a pad disposed on a platen, wherein the pad has a pad radius and a central axis from which the pad radius extends;

a carrier assembly configured to be disposed on a surface of the pad and having a carrier radius that extends from a rotational axis of the carrier assembly, wherein the rotational axis is disposed at a first radial distance from the central axis;

a first fluid delivery arm having a first nozzle configured to provide a first fluid to a first point on the pad at a second radial distance from the central axis;

a second fluid delivery arm having a second nozzle configured to provide a second fluid to a second point on the pad, the second point disposed a third radial distance from the central axis, wherein the second radial distance is less than the first radial distance, and the third radial distance is greater than or equal to the second radial distance; and a controller adapted to synchronize a movement of the second fluid delivery arm with a movement of the carrier assembly to cause the second fluid provided to the second point on the pad to have a consistent radial entry point under the carrier assembly.

2. The apparatus of claim 1, further comprising a first actuator that is configured to cause the carrier assembly to translate across a surface of the pad such that the first radial distance varies between a first radial value and a second radial value as the carrier assembly is translated across the surface of the pad; and a second actuator that is configured to cause the second fluid delivery arm to translate over the surface of the pad such that the third radial distance varies between a third radial value and a fourth radial value as the second fluid delivery arm is translated over the surface of the pad, wherein the fourth radial value is greater than the first radial value or the second radial value.

3. The apparatus of claim 2, further comprising a metrology unit disposed within the platen comprising a window disposed through the pad and a measurement unit, wherein the measurement unit is connected to the controller and is configured to measure a polishing rate near an edge of a substrate.

4. The apparatus of claim 1, wherein a magnitude of the third radial distance is less than a fourth radial distance that extends from the central axis to an outer most point on the carrier assembly.

5. The apparatus of claim 1, wherein the first fluid delivery arm overlaps an entirety of a radial position occupied by the carrier assembly over the pad.

6. The apparatus of claim 1, wherein the second fluid delivery arm extends over less than 60% of the pad radius.

7. The apparatus of claim 6, wherein the second fluid delivery arm comprises:

a fluid source; and a temperature control unit fluidly coupled to the fluid source and the second fluid delivery arm.

8. An apparatus for processing a substrate, comprising:

a platen;

a pad disposed on the platen, the pad having a pad radius extending from a central axis;

a carrier assembly disposed on the pad having a carrier radius that extends from a rotational axis of the carrier assembly;

a first fluid delivery arm extending over at least 50% of the pad radius and configured to provide a first fluid to a first point on the pad;

a second fluid delivery arm extending over less than 60% of the pad radius, the second fluid delivery arm configured to provide a second fluid to a second point on the pad, the second point disposed a radial distance from the central axis, the radial distance being greater than about 40% of the pad radius; and a controller adapted to synchronize a movement of the second fluid delivery arm with a movement of the carrier assembly to maintain a consistent distance between the second point on the pad and the carrier assembly.

9. The apparatus of claim 8, further comprising a metrology unit connected to the controller and configured to measure a polishing rate near an edge of a substrate.

10. The apparatus of claim 8, wherein the second fluid delivery arm comprises:

a base plate;

a swivel actuator coupled to the base plate;

an extension member extending over the pad; and a nozzle coupled to the extension member and disposed over the pad.

11. The apparatus of claim 10, wherein the first fluid delivery arm overlaps an entirety of a radial position occupied by the carrier assembly over the pad.

12. The apparatus of claim 10, further comprising:

a fluid source; and a temperature control unit fluidly coupled to the fluid source and the second fluid delivery arm.

13. The apparatus of claim 8, wherein the carrier assembly is disposed a distance of at least 10% of a total radius of the pad from a center of the pad and no more than 90% of the total radius of the pad from the center of the pad.

14. A method of polishing a substrate comprising:

urging a substrate against a surface of a pad of a polishing system using a carrier assembly, wherein the pad has a pad radius and a central axis from which the pad radius extends;

translating the carrier assembly across a surface of the pad while rotating the carrier assembly about a rotational axis;

dispensing a first fluid onto the pad from a first fluid delivery arm at a first temperature and a first flow rate, wherein the first fluid is delivered to the pad at a second radial distance that is measured from the central axis;

synchronizing a movement of the carrier assembly and a delivery of a second fluid onto the pad from a second fluid delivery arm, wherein synchronizing the movement of the carrier assembly and the delivery of the second fluid comprises synchronizing a movement of the second fluid delivery arm with a movement of the carrier assembly, the second fluid is delivered to the pad at a third radial distance that is measured from the central axis, such that the third radial distance is greater than the second radial distance, and the first fluid and the second fluid are simultaneously delivered onto the pad;

stopping the dispensing of the second fluid; and stopping the dispensing of the first fluid.

15. The method of claim 14, wherein the first fluid and the second fluid are different.

16. The method of claim 14, wherein a magnitude of the third radial distance is less than a fourth radial distance that extends from the central axis to an outer most point on the carrier assembly.

17. The method of claim 14, wherein a temperature of the second fluid is controlled by a temperature control unit to adjust a polishing rate.

18. The method of claim 14, wherein the second fluid is dispensed onto the pad at a radial position outward from an innermost edge of the carrier assembly with respect to the central axis of the pad, but inward from an outermost edge of the carrier assembly with respect to the central axis of the pad.

19. The method of claim 14, wherein the carrier assembly and the second fluid delivery arm are both moveable and track one another so the fluid dispensed from the second fluid delivery arm intersects a same portion of the carrier assembly as the carrier assembly is translated across the surface of the pad.

20. The method of claim 14, further comprising adjusting at least one of a temperature and a concentration of a combination of the first fluid and the second fluid by the delivering the second fluid onto the pad.

* * * * *